US009768009B2

(12) United States Patent
Hager et al.

(10) Patent No.: US 9,768,009 B2
(45) Date of Patent: Sep. 19, 2017

(54) SYSTEMS AND METHODS FOR ARBITRARY QUADRUPOLE TRANSMISSION WINDOWING

(71) Applicant: DH Technologies Development Pte. Ltd., Singapore (SG)

(72) Inventors: James Walter Hager, Mississauga (CA); Frank Londry, Omemee (CA); Nic G. Bloomfield, Newmarket (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/026,236

(22) PCT Filed: Oct. 7, 2014

(86) PCT No.: PCT/IB2014/002036

§ 371 (c)(1),
(2) Date: Mar. 30, 2016

(87) PCT Pub. No.: WO2015/056065

PCT Pub. Date: Apr. 23, 2015

(65) Prior Publication Data

US 2016/0233077 A1 Aug. 11, 2016

Related U.S. Application Data

(60) Provisional application No. 61/891,573, filed on Oct. 16, 2013.

(51) Int. Cl.

| | |
|---|---|
| ***H01J 49/42*** | (2006.01) |
| ***H01J 49/00*** | (2006.01) |
| ***H01J 49/04*** | (2006.01) |

(52) U.S. Cl.

CPC ..... *H01J 49/4215* (2013.01); *H01J 49/004* (2013.01); *H01J 49/0027* (2013.01); *H01J 49/04* (2013.01); *H01J 49/427* (2013.01)

(58) Field of Classification Search

USPC ..... 250/283

See application file for complete search history.

(56) References Cited

U.S. PATENT DOCUMENTS 8,809,772 B2 * 8/2014 Bonner ..... H01J 49/0031 250/282
8,822,916 B2 * 9/2014 Guna ..... H01J 49/26 250/281

(Continued)

FOREIGN PATENT DOCUMENTS

WO 2013098609 A1 7/2013
WO 2013098618 A1 7/2013

OTHER PUBLICATIONS

International Search Report and Written Opinion for PCT/IB2014/002036, mailed Jan. 26, 2015.

(Continued)

*Primary Examiner* — Phillip A Johnston

(74) *Attorney, Agent, or Firm* — John R. Kasha; Kelly L. Kasha; Kasha Law LLC

(57) ABSTRACT

Systems and methods are provided for shaping an effective transmission window used to select precursor ions for a precursor mass range of a sequential windowed acquisition experiment. For at least one precursor mass range, an ion transfer function is selected that is a function of mass using a processor. A quadrupole mass filter that transmits ions from a sample is instructed to produce two or more transmission windows over time using the processor. The two or more transmission windows are produced to cumulatively create an effective transmission window for the at least one precursor mass range with a shape described by the ion transfer function.

20 Claims, 11 Drawing Sheets

(56) References Cited

U.S. PATENT DOCUMENTS

| | | | | |
|---|---|---|---|---|
| 9,202,677 | B2 * | 12/2015 | Tate | H01J 49/0031 |
| 9,472,387 | B2 * | 10/2016 | Bloomfield | H01J 49/0027 |
| 2009/0194685 | A1 | 8/2009 | Corr et al. | |

OTHER PUBLICATIONS

Ludovic C. Gillet et al., Targeted Data Extraction of the MS/MS Spectra Generated by Data-Independent Acquisition: A New Concept for Consistent and Accurate Proteome Analysis, Molecular & Cellular Proteomics 11.6, Jun. 1, 2012.

Gerard Hopfgartner et al. "High-Resolution Mass Spectrometry for Integrated Qualitative and Quantitative Analysis of Pharmaceuticals in Biological Matrices," Analytical and Bioanalytical Chemistry. vol. 402, Issue 8, Dec. 28, 2011.

* cited by examiner

100

SYSTEMS AND METHODS FOR ARBITRARY QUADRUPOLE TRANSMISSION WINDOWING

CROSS REFERENCE TO RELATED APPLICATION

This application claims the benefit of U.S. Provisional Patent Application Ser. No. 61/891,573, filed Oct. 16, 2013, the content of which is incorporated by reference herein in its entirety.

INTRODUCTION

Tandem mass spectrometry or mass spectrometry/mass spectrometry (MS/MS) is a method that can provide both qualitative and quantitative information. In tandem mass spectrometry, a precursor ion is selected or transmitted by a first mass analyzer, fragmented, and the fragments, or product ions, are analyzed by a second mass analyzer or in a second scan of the first analyzer. The product ion spectrum can be used to identify a molecule of interest. The intensity of one or more product ions can be used to quantitate the amount of the compound present in a sample.

Selected reaction monitoring (SRM) is a well-known tandem mass spectrometry technique in which a single precursor ion is transmitted, fragmented, and the product ions are passed to a second analyzer, which analyzes a selected product mass range. A response is generated when the selected precursor ion fragments to produce a product ion in the selected fragment mass range. The response of the product ion can be used for quantitation, for example.

The sensitivity and specificity of a tandem mass spectrometry technique, such as SRM, is affected by the width of the precursor mass range, or precursor mass transmission window, selected by the first mass analyzer. Wide precursor mass ranges transmit more ions giving increased sensitivity. However, wide precursor mass ranges may also allow precursor ions of different masses to pass. If the precursor ions of other masses produce product ions at the same mass as the selected precursor, ion interference can occur. The result is decreased specificity.

In some mass spectrometers the second mass analyzer can be operated at high resolution and high speed, allowing different product ions to more easily be distinguished. To a large degree, this allows recovery of the specificity lost by using a wide precursor mass range. As a result, these mass spectrometers make it feasible to use a wide precursor mass range to maximize sensitivity while, at the same time, recovering specificity.

One tandem mass spectrometry technique that was developed to take advantage of this property of high resolution and high speed mass spectrometers is sequential windowed acquisition (SWATH). SWATH allows a mass range to be scanned within a time interval using multiple product ion scans of adjacent or overlapping precursor mass ranges. A first mass analyzer selects each precursor mass range for fragmentation. A high resolution second mass analyzer is then used to detect the product ions produced from the fragmentation of each precursor mass range. SWATH allows the sensitivity of precursor ion scans to be increased without the traditional loss in specificity.

Not all mass spectrometers are able to perform the SWATH technique in their standard configurations. For example, the first mass analyzers of some mass spectrometers do not uniformly transmit precursor ions within a wide precursor mass window. This makes it difficult to divide a mass range into adjacent or overlapping precursor mass windows. Furthermore there may be cases where it is useful to tailor the shape of the selection window, that is to deliberately construct windows where the ion transmission is not uniform with mass.

SUMMARY

A method is disclosed for shaping an effective transmission window used to select precursor ions for a precursor mass range of a sequential windowed acquisition (SWATH) experiment. For at least one precursor mass range, an ion transfer function is selected that is a function of mass using a processor. A quadrupole mass filter that transmits ions from a sample is instructed to produce two or more transmission windows over time using the processor. The two or more transmission windows are produced to cumulatively create an effective transmission window for the at least one precursor mass range with a shape described by the ion transfer function.

A system is disclosed for shaping an effective transmission window used to select precursor ions for a precursor mass range of a sequential windowed acquisition (SWATH) experiment. The system includes a quadrupole mass filter and a processor.

The quadrupole mass filter transmits ions from a sample. The processor selects at least one precursor mass range and an ion transfer function that is a function of mass. The processor instructs the quadrupole mass filter to produce two or more transmission windows over time. The two or more transmission windows cumulatively create an effective transmission window for the at least one precursor mass range with a shape of the ion transfer function.

A computer program product is disclosed that includes a non-transitory and tangible computer-readable storage medium whose contents include a program with instructions being executed on a processor so as to perform a method for shaping an effective transmission window used to select precursor ions for a precursor mass range of a SWATH experiment.

In various embodiments, the method includes providing a system, wherein the system comprises one or more distinct software modules, and wherein the distinct software modules comprise a selection module and a control module. For at least one precursor mass range, the selection module selects an ion transfer function that is a function of mass.

The control module instructs a quadrupole mass filter that transmits ions from a sample to produce two or more transmission windows over time. The two or more transmission windows are produced to cumulatively create an effective transmission window for the at least one precursor mass range with a shape described by the ion transfer function.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
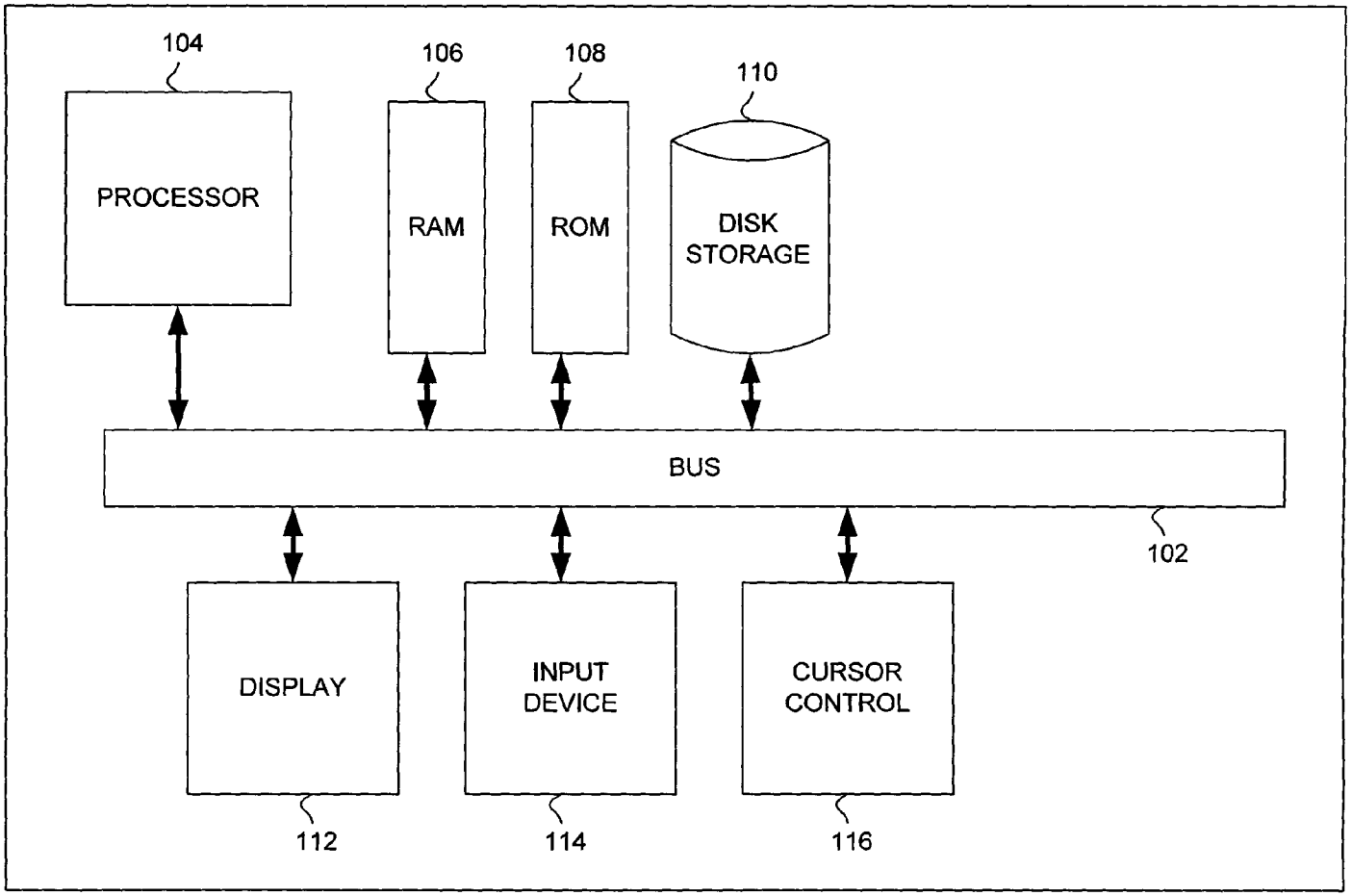
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems And Methods For Shaping Transmission Windows

As described above, sequential windowed acquisition (SWATH) is a tandem mass spectrometry technique that allows a mass range to be scanned within a time interval using multiple product ion scans of adjacent or overlapping precursor mass ranges. A first mass analyzer selects each precursor mass range for fragmentation. A high resolution second mass analyzer is then used to detect the product ions produced from the fragmentation of each precursor mass range. SWATH allows the sensitivity of precursor ion scans to be increased without the traditional loss in specificity.

Unfortunately, however, not all mass spectrometers are able to perform the SWATH technique in their current configurations. For example, the first mass analyzers of some mass spectrometers do not generate a transmission window that can be used to uniformly transmit precursor ions within a precursor mass range. This makes it difficult to divide a mass range into adjacent or overlapping precursor mass ranges.

Figure 2:
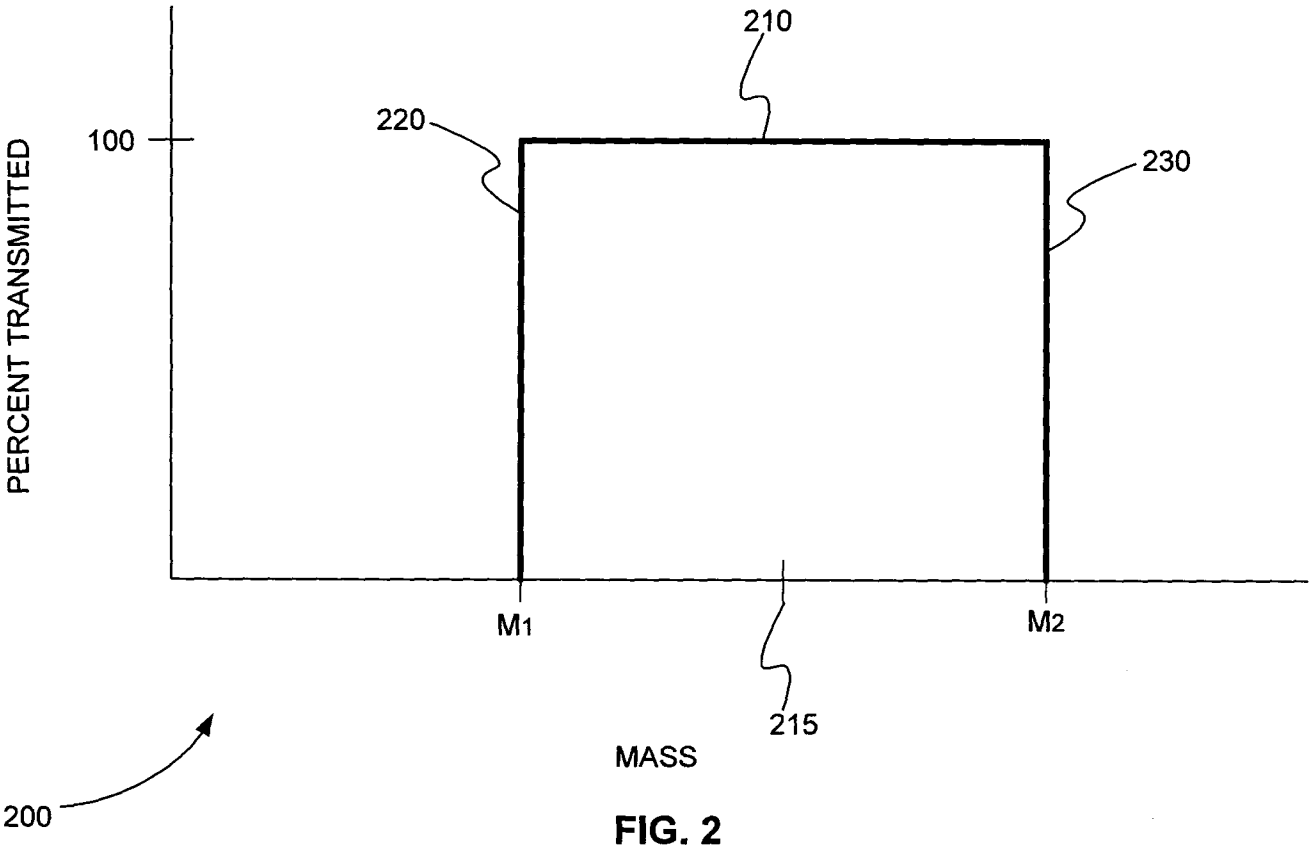
FIG. 2 is an exemplary plot of an ideal transmission window that is used to transmit a sequential windowed acquisition (SWATH) precursor mass range, in accordance with various embodiments.

FIG. 2 is an exemplary plot 200 of an ideal transmission window that is used to transmit a SWATH precursor mass range, in accordance with various embodiments. Ideal transmission window 210 transmits precursor ions with masses between $M_1$ and $M_2$ and has set mass, or center mass, 215. The SWATH window size is $M_2$-$M_1$. These precursor ions are transmitted uniformly, because ideal transmission window 210 has sharp vertical edges 220 and 230. In other words, the rate of transmission of precursor ions by ideal transmission window 210 is uniform or constant as the mass increases from $M_1$ to $M_2$. Unfortunately, however, many mass spectrometers cannot produce transmission windows with edges that are as sharp as edges 220 and 230. In addition, the exact shape of the edges of some mass spectrometers may not be known.

Figure 3:
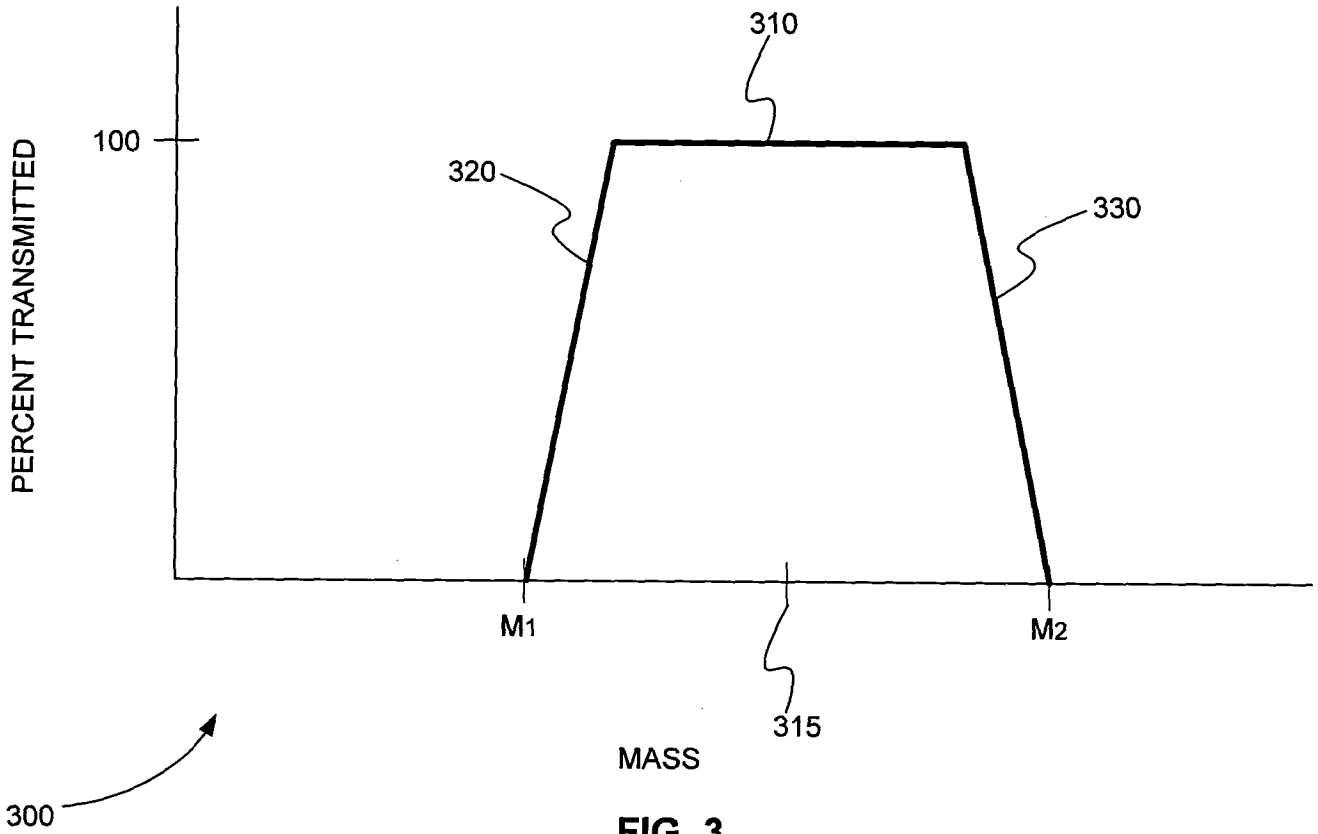
FIG. 3 is an exemplary plot of a non-ideal transmission window used to transmit a SWATH precursor mass range, in accordance with various embodiments.

FIG. 3 is an exemplary plot 300 of a non-ideal transmission window used to transmit a SWATH precursor mass range, in accordance with various embodiments. Non-ideal transmission window 310 is also used to transmit precursor ions with masses between $M_1$ and $M_2$ and has a set mass 315. The SWATH window size is $M_2$-$M_1$. Non-ideal transmission window 310, however, does not have sharp edges 220 and 230, like ideal transmission window 210 shown in FIG. 2. Edges 320 and 330 of FIG. 3, for example, vary with mass. In other words, the rate of transmission of precursor ions by non-ideal transmission window 310 is non-uniform or not constant as the mass changes at edges 320 and 330. In addition this variation with mass may not be known or may not be predictable. Some quadrupoles, for example, produce transmission windows that are more triangular, like non-ideal transmission window 310, when the resolution is increased.

Transmission windows, like non-ideal transmission window 310 of FIG. 3, create a number of problems for the SWATH method. In order to provide uniform precursor ion transmission across each entire SWATH window, the width of these transmission windows must be increased, which also increases the overlap between SWATH precursor mass ranges. This can result in increased duty cycle and an increased need to recover even more specificity in the second mass analyzer.

In various embodiments, two or more transmission windows are used over time to shape an effective transmission window that is used to transmit precursor ions of a precursor mass range of a SWATH method. The two or more transmission windows are used, for example, to shape an effective transmission window like the ideal transmission window shown in FIG. 2. The width, set mass or center mass, and the duration of each of the two or more transmission windows can vary or can be held constant.

Figure 4:
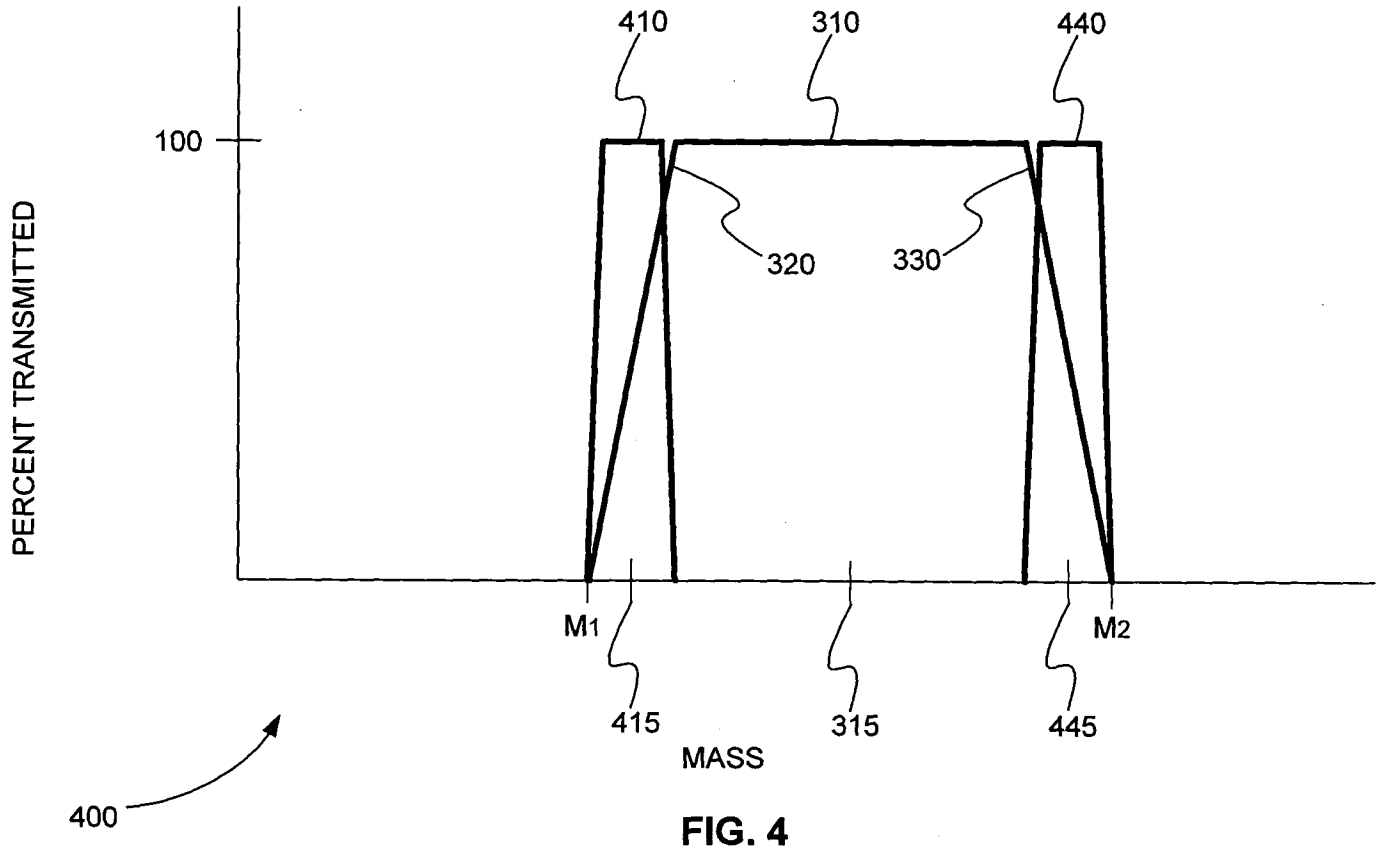
FIG. 4 is an exemplary plot of three non-ideal transmission windows used over time to shape an effective transmission window that is used to transmit a SWATH precursor mass range, in accordance with various embodiments.

FIG. 4 is an exemplary plot 400 of three non-ideal transmission windows used over time to shape an effective transmission window that is used to transmit a SWATH precursor mass range, in accordance with various embodiments. Plot 400 includes non-ideal transmission windows 410, 310, and 440. Non-ideal transmission windows 410, 310, and 440 have set masses 415, 315, and 445, respectively. Non-ideal transmission windows 410 and 440 are used, for example, to sharpen edges 320 and 330 of non-ideal transmission window 310. Non-ideal transmission window 440 can be non-ideal transmission window 410 moved to a different set mass at a different time, for example, or can be a different transmission window. Non-ideal transmission windows 410, 310, and 440 are used at three different times to cumulatively produce an effective transmission window closer to ideal transmission window 210 of FIG. 2.

FIG. 4 depicts a method of using two or more non-uniform transmission windows over time to produce a uniform effective transmission window. Generally, a transmission window or an effective transmission window that transmits precursor ions uniformly across a SWATH precursor mass range is desired. However, a non-uniform transmission window or a non-uniform effective transmission window may also be desirable, if the non-uniformity is well known.

In various embodiments, two or more transmission windows are used over time to shape a non-uniform effective transmission window that is used to transmit precursor ions of a precursor mass range of a SWATH method. The two or more transmission windows are, for example, windows that are narrower than the SWATH precursor mass range. The two or more transmission windows can be transmission windows that vary in width, set mass, and/or duration, for example. Alternatively, the two or more transmission windows can be one uniform transmission window that is stepped across the SWATH precursor mass range.

The shape of the non-uniform effective transmission window can be any arbitrary shape that varies with mass. The shape of the non-uniform effective transmission window can include, but is not limited to, a triangle, an inverted triangle, a curve, or a triangle or curve with notches. It should be noted, however, that increasingly complex shapes are likely to decrease the overall throughput of the system.

Figure 5:
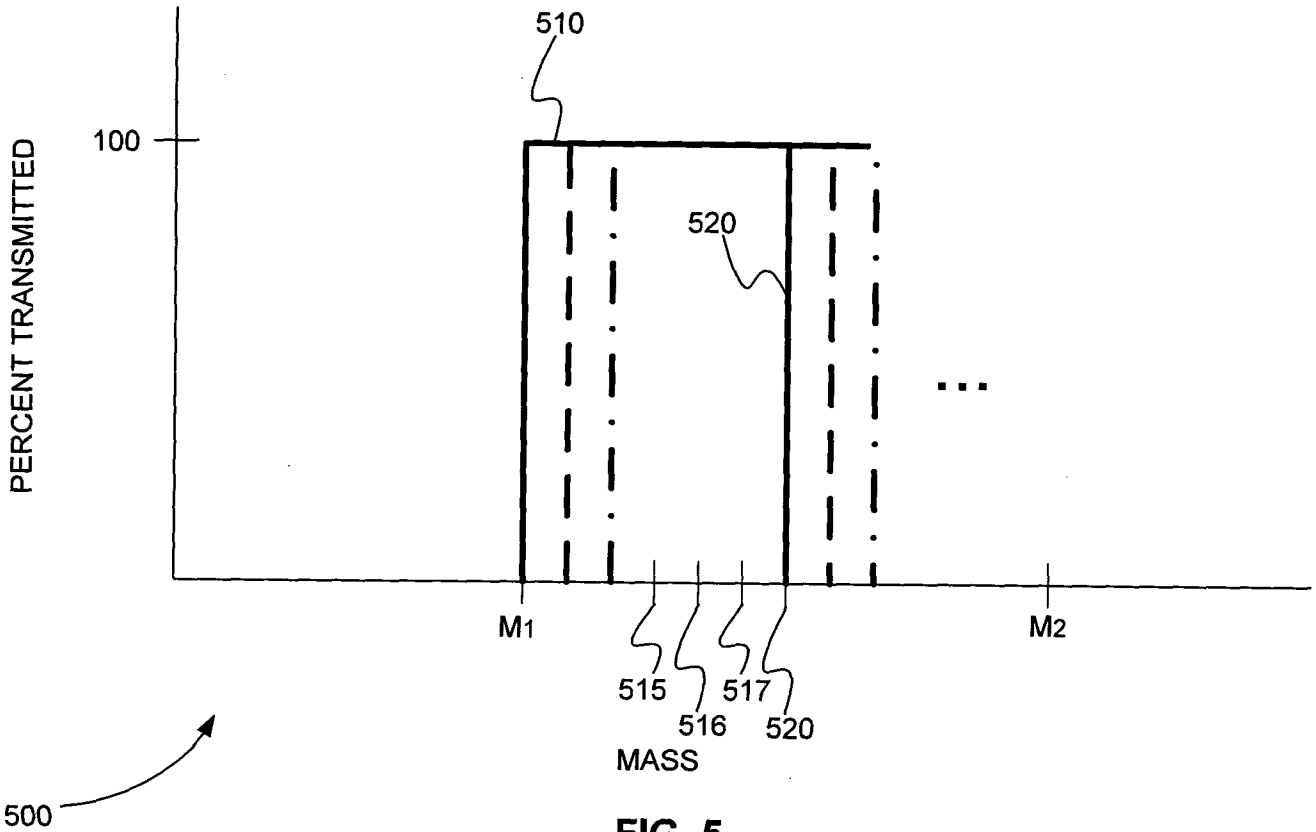
FIG. 5 is an exemplary plot of a uniform transmission window that is shifted over time across a SWATH precursor mass range to produce a non-uniform effective transmission window for the SWATH precursor mass range, in accordance with various embodiments.

FIG. 5 is an exemplary plot 500 of a uniform transmission window that is shifted over time across a SWATH precursor mass range to produce a non-uniform effective transmission window for the SWATH precursor mass range, in accordance with various embodiments. Uniform transmission window 510 has, for example, half the width of SWATH precursor mass range $M_2$-$M_1$. A triangular effective transmission window (not shown), having an apex at mass 520, is produced by stepping uniform transmission window 510 across the SWATH precursor mass range $M_2$-$M_1$. For example, uniform transmission window 510 is stepped from set mass 515 to set mass 516, and then from set mass 516 to set mass 517 over time. Uniform transmission window 510 is stepped across the SWATH precursor mass range $M_2$-$M_1$ until edge 530 reaches mass $M_2$, for example. As a result, precursor ions near mass 520 are almost always being transmitted, while ions near mass $M_1$ and mass $M_2$ are almost never transmitted. Ions between mass $M_1$ and mass 520 are transmitted according to the slope of one side of the triangular effective transmission window, and ions between mass 520 and mass $M_2$ are transmitted according to the slope of another side of the triangular effective transmission window.

Uniform transmission window 510 is shown in plot 500 as an ideal or near ideal transmission window. Although having the sharp edges of an ideal or near ideal transmission window is important, it is not necessary. What is necessary, however, is the use of known regions of two or more transmission windows to shape a non-uniform effective transmission window.

Experimental Results

Following a method similar to that shown in FIG. 5, the set mass of a dynamic transmission window was ramped linearly during a 100 ms SWATH dwell period using a quadrupole. The static (rectangular) SWATH window was 20 Da wide and the dynamic transmission window of width 10 Da was ramped linearly over a 10 Da range during the SWATH dwell period. Although the SWATH window was 20 Da wide, the effective fill time was a maximum in the middle and dropped linearly to zero at the low and high mass boundaries.

Figure 6:
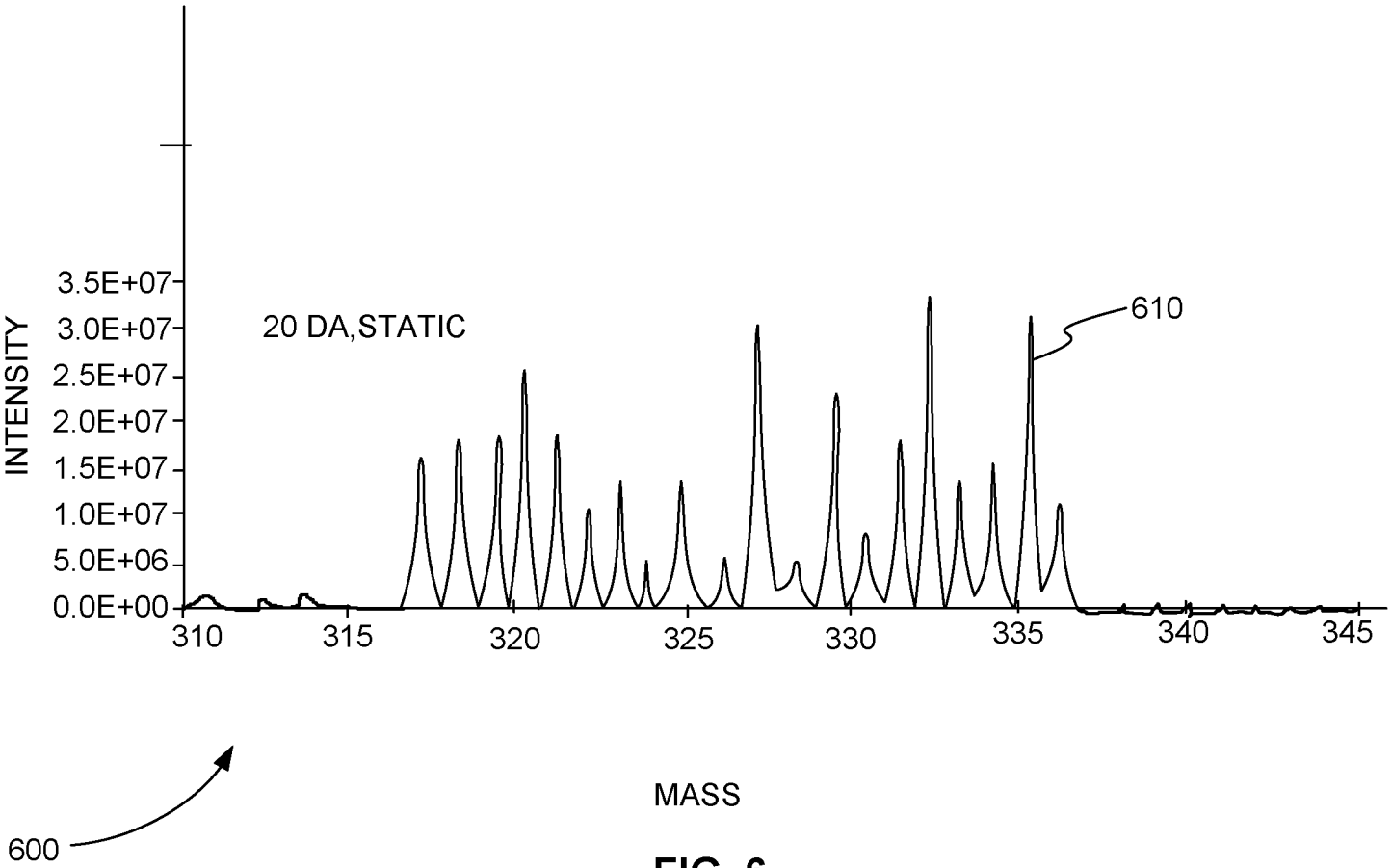
FIG. 6 is exemplary plot of a 20 Da range of a precursor mass spectrum for a polypropylene glycol (PPG) solution that was produced using a static 20 Da transmission window in a SWATH experiment, in accordance with various embodiments.

FIG. 6 is exemplary plot 600 of a 20 Da range of a precursor mass spectrum 610 for a polypropylene glycol (PPG) solution that was produced using a static 20 Da transmission window in a SWATH experiment, in accordance with various embodiments. Precursor ions for the SWATH precursor mass range between 317 and 337 Da were transmitted using a single static transmission window that was essentially the same width as the SWATH precursor mass range. In other words, precursor mass spectrum 610 was produced using a transmission window similar to the transmission window shown in FIG. 2. Note that the mass intensities of PPG mass spectrum 610 between 317 and 337 Da are relatively uniform.

Figure 7:
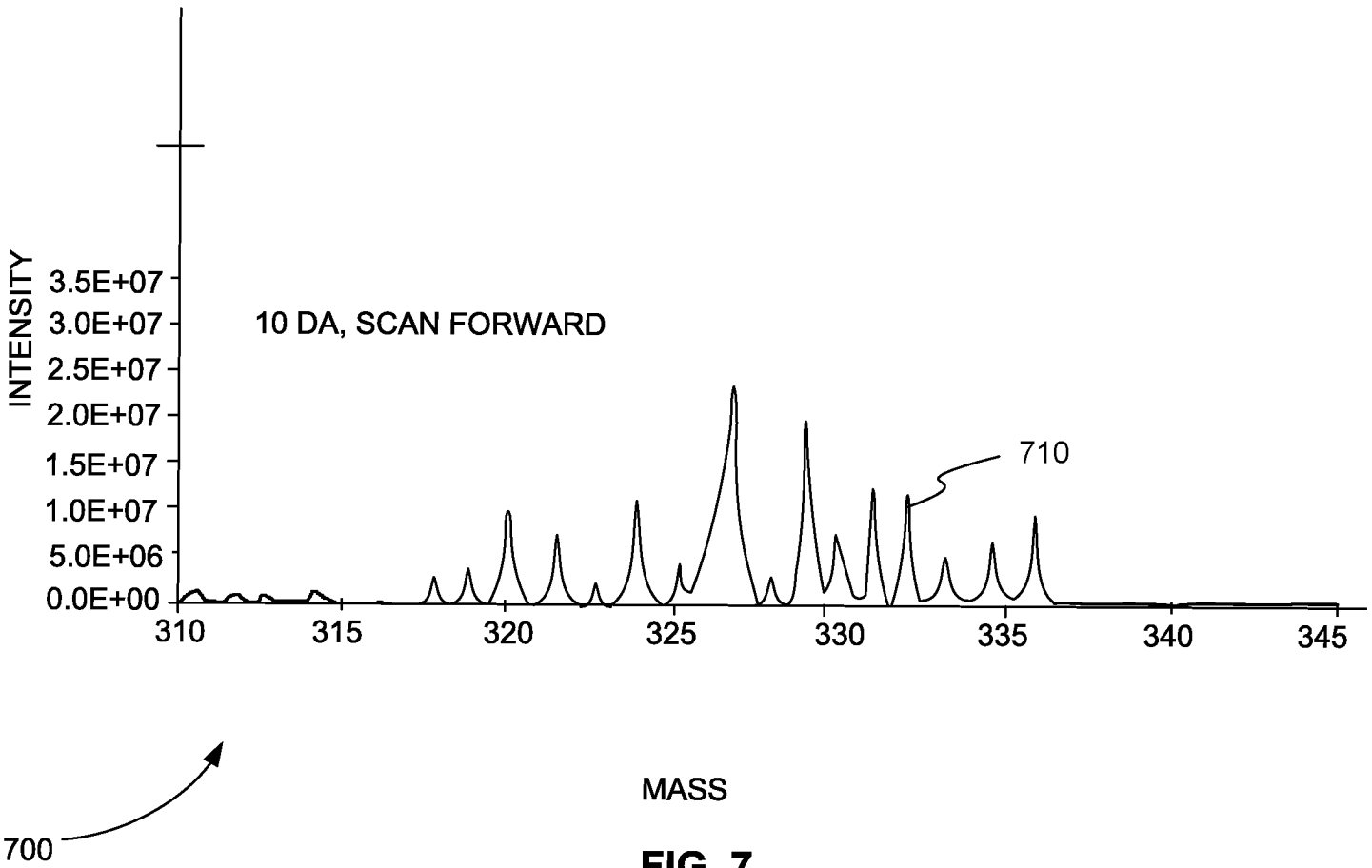
FIG. 7 is exemplary plot of a 20 Da range of a precursor mass spectrum for a PPG solution that was produced using a plurality of dynamic 10 Da transmission windows stepped linearly across a 20 Da mass window in a SWATH experiment, in accordance with various embodiments.

FIG. 7 is exemplary plot 700 of a 20 Da range of a precursor mass spectrum 710 for a PPG solution that was produced using a plurality of dynamic 10 Da transmission windows stepped linearly across a 20 Da mass window in a SWATH experiment, in accordance with various embodiments. Custom cycles were used to ramp a single 10 Da uniform transmission window over a plurality of time periods and with a plurality of set masses across a 20 Da SWATH precursor mass range. In other words, precursor mass spectrum 710 was produced using a single uniform transmission window that was moved across the SWATH precursor mass range over time, similar to the method shown in FIG. 5. The mass intensities of PPG mass spectrum 710 between 317 and 337 Da have a triangular shape, in contrast to the mass intensities of PPG mass spectrum 610 shown in FIG. 6.

Figure 8:
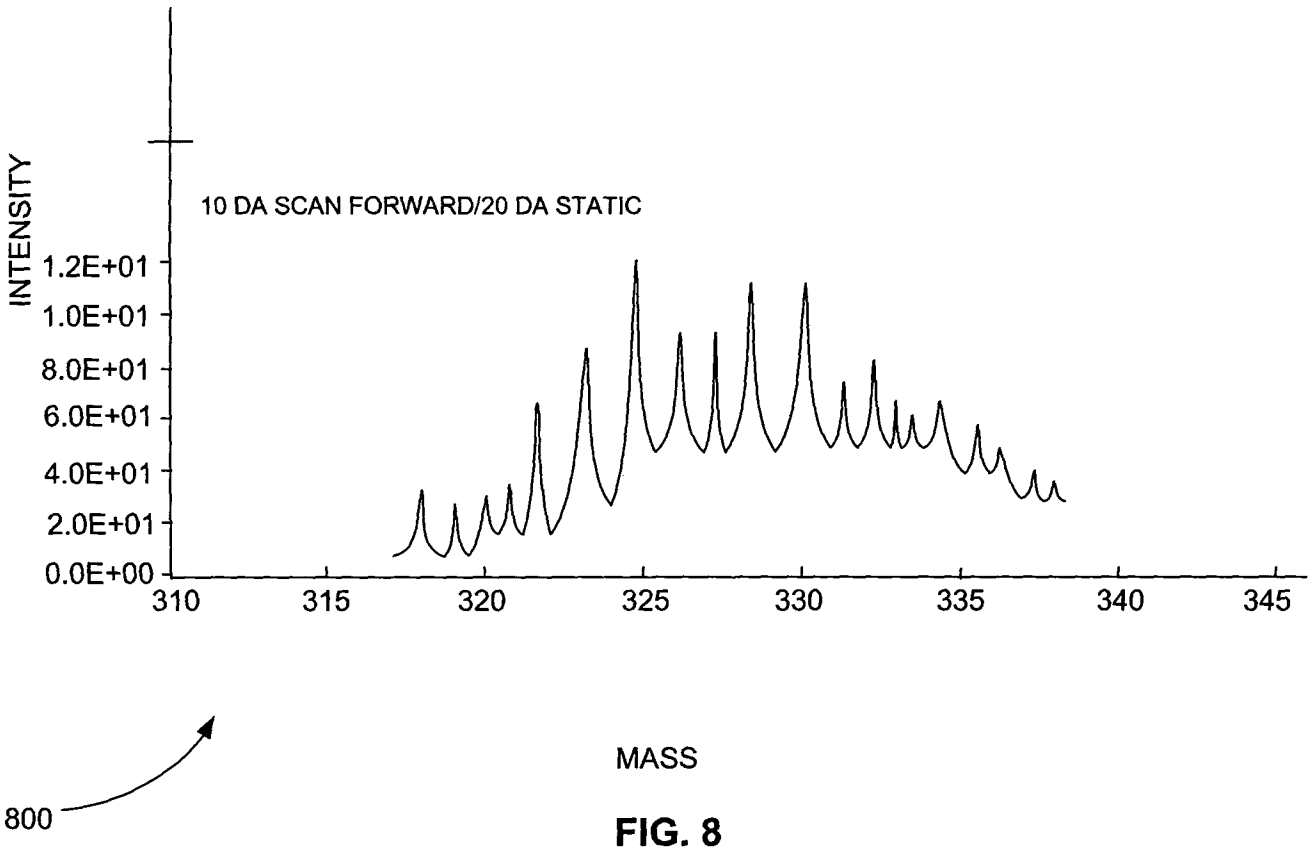
FIG. 8 is an exemplary plot of the mass intensities of PPG mass spectrum of FIG. 7 divided by the mass intensities of PPG mass spectrum of FIG. 6, in accordance with various embodiments.

FIG. 8 is an exemplary plot 800 of the mass intensities of PPG mass spectrum 710 of FIG. 7 divided by the mass intensities of PPG mass spectrum 610 of FIG. 6, in accordance with various embodiments. Plot 800 confirms the triangular shape of the effective transmission window created by using a plurality of dynamic 10 Da transmission windows stepped linearly across a 20 Da mass window. Essentially, a triangular transfer function in the mass dimension was created using a plurality of transmission windows stepped linearly across a SWATH precursor mass range.

System for Shaping Transmission Windows

Figure 9:
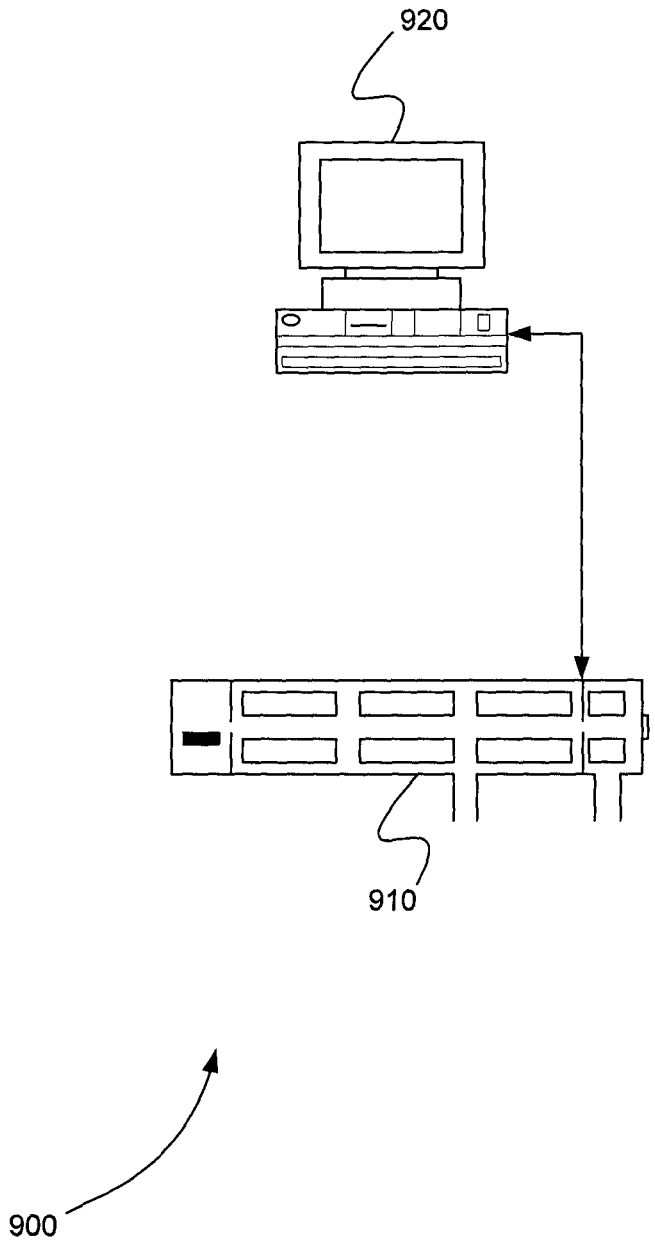
FIG. 9 is a schematic diagram showing a system for shaping an effective transmission window used to select precursor ions for a precursor mass range of a SWATH experiment, in accordance with various embodiments.

FIG. 9 is a schematic diagram showing a system 900 for shaping an effective transmission window used to select precursor ions for a precursor mass range of a SWATH experiment, in accordance with various embodiments. System 900 includes quadrupole mass filter 910 and processor 920.

Quadrupole mass filter 910 can include one or more physical mass analyzers that perform two or more mass analyses. Quadrupole mass filter 910 can also include a separation device (not shown). The separation device can perform a separation technique that includes, but is not limited to, liquid chromatography, gas chromatography, capillary electrophoresis, or ion mobility.

Processor 920 can be, but is not limited to, a computer, microprocessor, or any device capable of sending and receiving control signals and data from quadrupole mass filter 910 and processing data. Processor 920 is in communication with quadrupole mass filter 910.

Quadrupole mass filter 910 transmits ions from a sample. During acquisition, processor 920 selects at least one precursor mass range and an ion transfer function that is a function of mass, and instructs the quadrupole mass filter to produce two or more transmission windows over time that cumulatively create an effective transmission window for the at least one precursor mass range with a shape of the ion transfer function.

In various embodiments, the ion transfer function defines a constant rate of precursor ion transmission as a function of mass.

In various embodiments, the ion transfer function defines a non-constant rate of precursor ion transmission as a function of mass.

In various embodiments, processor 920 instructs the quadrupole mass filter to produce two or more transmission windows over time that cumulatively create an effective transmission window for the at least one precursor mass range with the shape of the ion transfer function by instructing quadrupole mass filter 910 to vary one or more quadrupole parameters affecting a width, central mass, or duration of the two or more transmission windows over time.

In various embodiments, a quadrupole parameter affecting a central mass of the two or more transmission windows comprises a radio frequency (RF) parameter, and a quadrupole parameter affecting a width of the two or more transmission windows comprises a ratio of the RF parameter to a direct current (DC) parameter.

In various embodiments, a width of each transmission window of the two or more transmission windows is smaller than a width of the at least one precursor mass range.

In various embodiments, the one or more transmission windows are overlapped so that parts of the mass range are transmitted more often than others.

In various embodiments, a width of each transmission window of the two or more transmission windows is smaller than a width of the at least one precursor mass range, and overlap between any two transmission windows of the two or more transmission windows is less than the width of either transmission window of the any two transmission windows.

In various embodiments, the overlap is a small portion of a fraction of each of the two transmission windows. For example, each transmission window of the two or more transmission windows is one half of the at least one precursor mass range and the overlap between any two transmission windows of the two or more transmission windows is less than ten percent of the width of either transmission window of the any two transmission windows.

Method for Shaping Transmission Windows

Figure 10:
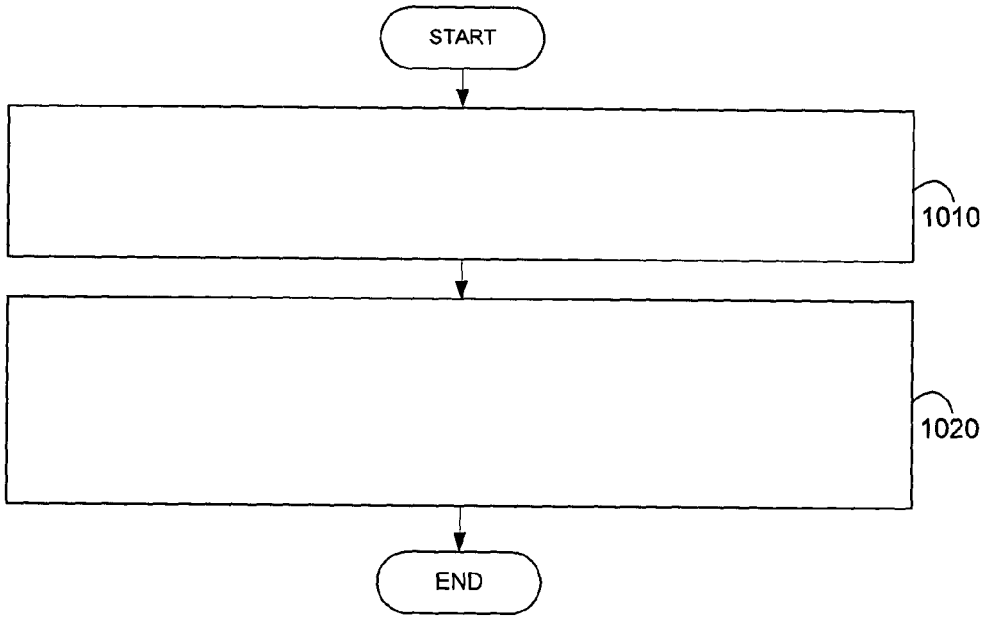
FIG. 10 is an exemplary flowchart showing a method for shaping an effective transmission window used to select precursor ions for a precursor mass range of a SWATH experiment, in accordance with various embodiments.
Figure 10:
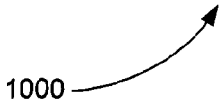

FIG. 10 is an exemplary flowchart showing a method 1000 for shaping an effective transmission window used to select precursor ions for a precursor mass range of a SWATH experiment, in accordance with various embodiments.

In step 1010 of method 1000, for at least one precursor mass range, an ion transfer function is selected that is a function of mass using a processor.

In step 1020, a quadrupole mass filter that transmits ions from a sample is instructed to produce two or more transmission windows over time using the processor. The two or more transmission windows are produced to cumulatively create an effective transmission window for the at least one precursor mass range with a shape described by the ion transfer function.

Computer Program Product for Shaping Transmission Windows

In various embodiments, computer program products include a tangible computer-readable storage medium whose contents include a program with instructions being executed on a processor so as to perform a method for shaping an effective transmission window used to select precursor ions for a precursor mass range of a sequential windowed acquisition experiment. This method is performed by a system that includes one or more distinct software modules.

Figure 11:
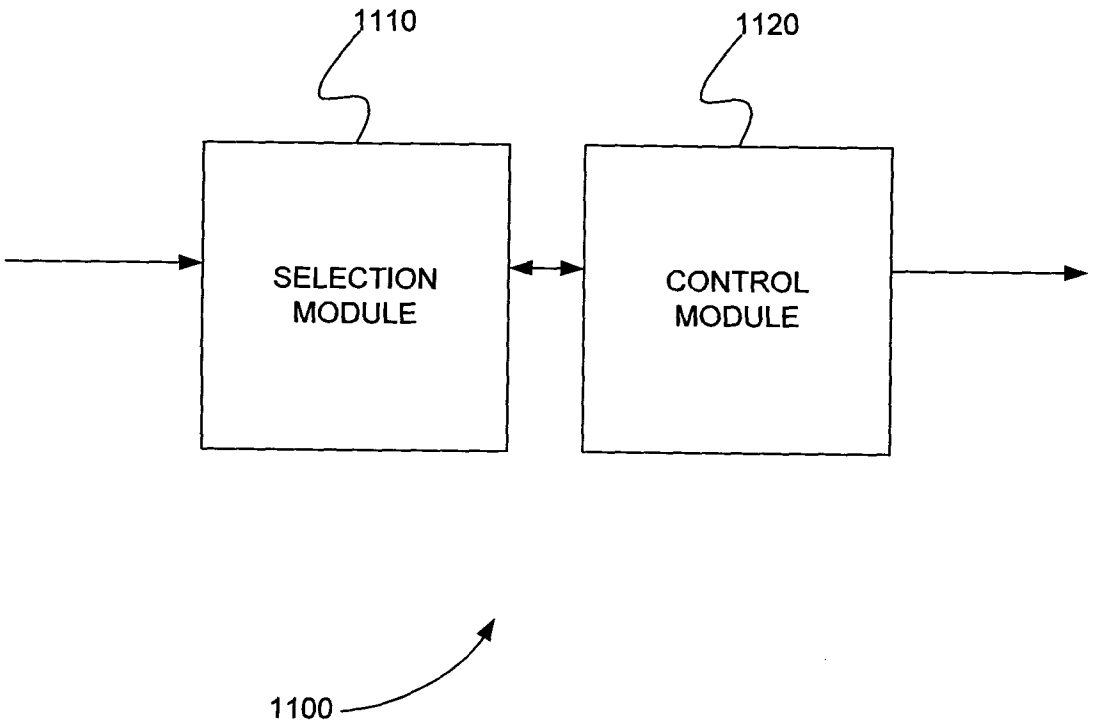
FIG. 11 is a schematic diagram of a system that includes one or more distinct software modules that perform a method for shaping an effective transmission window used to select precursor ions for a precursor mass range of a SWATH experiment, in accordance with various embodiments.

FIG. 11 is a schematic diagram of a system 1100 that includes one or more distinct software modules that performs a method for shaping an effective transmission window used to select precursor ions for a precursor mass range of a SWATH experiment, in accordance with various embodiments. System 1100 includes selection module 1110 and control module 1120.

For at least one precursor mass range, selection module 1110 selects an ion transfer function that is a function of mass.

Control module 1120 instructs a quadrupole mass filter that transmits ions from a sample to produce two or more transmission windows over time. The two or more transmission windows are produced to cumulatively create an effective transmission window for the at least one precursor mass range with a shape described by the ion transfer function.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A method for shaping an effective transmission window used to select and transmit precursor ions for a precursor mass range of a sequential windowed acquisition experiment, comprising:

for at least one precursor mass range, selecting a shape of an effective transmission window that is used to transmit precursor ions within the at least one precursor mass range using a processor; and instructing a quadrupole mass filter that transmits the precursor ions from a sample to produce two or more transmission windows that are used over time to create the effective transmission window with the selected shape for transmitting the precursor ions within the at least one precursor mass range using the processor.

2. The method of claim 1, wherein the selected shape comprises a uniform shape of precursor ion transmission as a function of mass.

3. The method of claim 1, wherein the selected shape comprises a nonuniform shape of precursor ion transmission as a function of mass.

4. The method of claim 3, wherein the shape comprises one or more of a triangle, an inverted triangle, a curve, and a triangle or curve with notches.

5. The method of claim 1, wherein instructing the quadrupole mass filter to produce two or more transmission windows comprises instructing the quadrupole mass filter to vary one or more quadrupole parameters affecting a width, central mass, or duration of the two or more transmission windows over time.

6. The method of claim 5, wherein a quadrupole parameter affecting a central mass of the two or more transmission windows comprises a radio frequency (RF) parameter, and a quadrupole parameter affecting a width of the two or more transmission windows comprises a ratio of the RF parameter to a direct current (DC) parameter.

7. The method of claim 5, wherein a width of each transmission window of the two or more transmission windows is smaller than a width of the at least one precursor mass range.

8. The method of claim 1, wherein the one or more transmission windows are overlapped so that parts of the mass range are transmitted more often than others.

9. The method of claim 8, wherein a width of each transmission window of the two or more transmission windows is smaller than a width of the at least one precursor mass range and wherein overlap between any two transmission windows of the two or more transmission windows is less than the width of either transmission window of the any two transmission windows.

10. A system for shaping an effective transmission window used to select and transmit precursor ions for a tandem mass spectrometry experiment, comprising:

a quadrupole mass filter that transmits precursor ions from a sample; and a processor in communication with the quadrupole mass filter that during acquisition selects at least one precursor mass range and a shape of an effective transmission window that is used to transmit the precursor ions within the at least one precursor mass range, and instructs the quadrupole mass filter to produce two or more transmission windows that are used over time to create the effective transmission window with the selected shape for transmitting the precursor ions within the at least one precursor mass range.

11. The system of claim 10, wherein the selected shape comprises a uniform shape of precursor ion transmission as a function of mass.

12. The system of claim 10, wherein the selected shape comprises a uniform shape of precursor ion transmission as a function of mass.

13. The system of claim 10, wherein the processor instructs the quadrupole mass filter to produce two or more transmission windows by instructing the quadrupole mass filter to vary one or more quadrupole parameters affecting a width, central mass, or duration of the two or more transmission windows over time.

14. The system of claim 13, wherein a quadrupole parameter affecting a central mass of the two or more transmission windows comprises a radio frequency (RF) parameter, and a quadrupole parameter affecting a width of the two or more transmission windows comprises a ratio of the RF parameter to a direct current (DC) parameter.

15. A computer program product, comprising a non-transitory and tangible computer-readable storage medium whose contents include a program with instructions being executed on a processor so as to perform a method for shaping an effective transmission window used to select and transmit precursor ions for a precursor mass range of a sequential windowed acquisition experiment, the method comprising:

providing a system, wherein the system comprises one or more distinct software modules, and wherein the distinct software modules comprise a selection module and a control module;

for at least one precursor mass range, selecting a shape of an effective transmission window that is used to transmit precursor ions within the at least one precursor mass range using the selection module; and instructing a quadrupole mass filter that transmits the precursor ions from a sample to produce two or more transmission windows that are used over time to create the effective transmission window with the selected shape for transmitting the precursor ions within the at least one precursor mass range using the control module.

16. The computer medium product of claim 15, wherein the selected shape comprises a uniform shape of precursor ion transmission as a function of mass.

17. The computer medium product of claim 15, wherein the selected shape comprises a uniform shape of precursor ion transmission as a function of mass.

18. The computer medium product of claim 15, wherein instructing the quadrupole mass filter to produce two or more transmission windows comprises instructing the quadrupole mass filter to vary one or more quadrupole parameters affecting a width, central mass, or duration of the two or more transmission windows over time.

19. The computer medium product of claim 18, wherein a width of each transmission window of the two or more transmission windows is smaller than a width of the at least one precursor mass range.

20. The computer medium product of claim 15, wherein the one or more transmission windows are overlapped so that parts of the mass range are transmitted more often than others.

* * * * *